US009198823B1

(12) United States Patent
Whited

(10) Patent No.: US 9,198,823 B1
(45) Date of Patent: Dec. 1, 2015

(54) WALKER AND STANDING AID

(71) Applicant: Christopher Justin Whited, Rossville, GA (US)

(72) Inventor: Christopher Justin Whited, Rossville, GA (US)

( * ) Notice: Subject to any disclaimer, the term of this patent is extended or adjusted under 35 U.S.C. 154(b) by 0 days.

(21) Appl. No.: 14/644,591

(22) Filed: Mar. 11, 2015

Related U.S. Application Data

(60) Provisional application No. 61/973,893, filed on Apr. 2, 2014.

(51) Int. Cl.
*E04H 3/04* (2006.01)
*A61H 3/04* (2006.01)

(52) U.S. Cl.
CPC ..... *A61H 3/04* (2013.01); *A61H 2201/1635* (2013.01)

(58) Field of Classification Search
CPC .... A61H 3/04; A61H 3/00; A61H 2201/1635
USPC ..... 135/65–67, 72, 76; 482/66–67, 140; 280/650, 657, 639; 5/81.1 R, 83.1
See application file for complete search history.

(56) References Cited

U.S. PATENT DOCUMENTS

| | | | | | |
|---|---|---|---|---|---|
| 1,307,058 | A * | 6/1919 | McGrath | 297/5 |
| 2,855,024 | A * | 10/1958 | Robb | 135/67 |
| 4,094,331 | A * | 6/1978 | Rozsa | 135/67 |
| 4,341,381 | A * | 7/1982 | Norberg | 482/67 |
| 4,748,994 | A * | 6/1988 | Schultz et al. | 135/67 |
| 6,371,142 | B1 * | 4/2002 | Battiston | 135/67 |
| 6,386,575 | B1 * | 5/2002 | Turner | 280/647 |
| 6,733,018 | B2 * | 5/2004 | Razon | 280/87.021 |
| 6,990,990 | B2 * | 1/2006 | Wilensky et al. | 135/67 |
| 8,714,171 | B1 * | 5/2014 | Haygood | 135/66 |
| 2004/0020525 | A1 * | 2/2004 | Lev | 135/66 |
| 2014/0175766 | A1 * | 6/2014 | Peterson | 280/87.041 |
| 2014/0261591 | A1 * | 9/2014 | Velarde | 135/67 |

* cited by examiner

*Primary Examiner* — Winnie Yip
(74) *Attorney, Agent, or Firm* — Stephen J. Stark

(57) ABSTRACT

A walker and standing aid provides lift assist handles operably coupled to opposing tracks connected to the walker. The handles can transition between lift and adjustment configurations whereby when in the lift configuration, a person's weight can be supported thereby and when in the adjustment configuration the lift assist handle can be elevationally adjusted relative to the track. For preferred embodiments, the handles are infinitely adjustable within a range of motion along the tracks.

20 Claims, 3 Drawing Sheets

WALKER AND STANDING AID

CLAIM OF PRIORITY

This application claims the benefit of U.S. Provisional Patent Application No. 61/973,893 filed Apr. 2, 2014 which is incorporated herein by reference in its entirety.

FIELD OF THE INVENTION

The present invention relates to walkers and/or standing aids for use by those of possibly limited mobility, and in particular a device which can provide for relatively easy elevation adjustment, such as without tools, and possibly over an infinite selection of elevations within a predetermined range.

BACKGROUND OF THE INVENTION

Walkers are a relatively well established piece of medical equipment. Some have at least some wheels, some do not.

Some walkers, such as U.S. Pat. No. 6,990,990, are a significant improvement over prior art walkers in that this design provides a lower set of handles which can pivot about an axis parallel to the front legs for use as a standing aid. However, for this design, the user, or another person, sets the height of the lower handles with collar clamps 250 which are then not easily changed by the user, and certainly not elevationally positionable as one works their way up from a seated position.

Furthermore, the design of the walker of the '990 patent limits the range of motion elevationally to a range between the top and bottom front cross members. These cross members at least prevent a clamp from being slid through either of the positions of the top and bottom front cross members without first removing the clamp from the walker. This range is believed to be too limited for many embodiments.

Accordingly, there is a need for an improved walker construction.

There is also a need for an improved standing aid for at least some individuals.

SUMMARY OF THE INVENTION

It is an object of many embodiments of the present invention to provide an improved walker construction which allows a user to relatively easily select an elevation for the lift assist handles.

It is another object of many embodiments of the present invention for the user to adjust the height of one lift assist handle while leaning on the other, and vice versa, to effectively "walk up" to a standing position.

It is yet another object of many embodiments of the present invention to provide opposing tracks which respectively receives lift assist handles therealong over a range for at least some embodiments extending below the bottom front crossbar, or even below the bottom side crossbar to above the top front crossbar, or even the top side crossbar for at least some embodiments.

It is yet another object of many embodiments of the present invention to allow the user to select one of an infinite selection of elevations for the lift assist handles over a range, preferably without tools.

Accordingly, in accordance with a presently preferred embodiment of the present invention, a walker configuration provides a standing aid having opposing tracks which receive bases of lift assist handles therein. The bases of the lift assist handles are preferably constructed to be elevationally positionable such as by rotating the bases out of a friction hold configuration, such as in a downward position, to an upward or position allowing the bases to move up and down within the tracks. At a desired elevation, the handle is then rotated to the friction hold position (such as downward) where the base can be retained by friction in the track at a desired elevation. For many embodiments, this change in elevation can occur without tools.

The tracks are preferably connected to top and bottom side crossbars and extend over an elevation range further for many embodiments than the front top and bottom crossbars. Furthermore, the tracks may allow for the positioning of the handles below the bottom side crossbars as well as over the top side crossbars.

For many embodiments, there is an infinite selection of elevations over the range as opposed to selecting from a select number of possible elevation locations. Furthermore, for at least preferred embodiments, the user can "walk up", possibly by applying pressure to one lift assist handle and raising the other handle to a desired elevation and then applying pressure to that lift assist handle and vise versa until the user is in a standing position.

For many embodiments the tracks can be located at or between the front and rear legs, and for at least some embodiments, the tracks can be supported by the side cross members.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
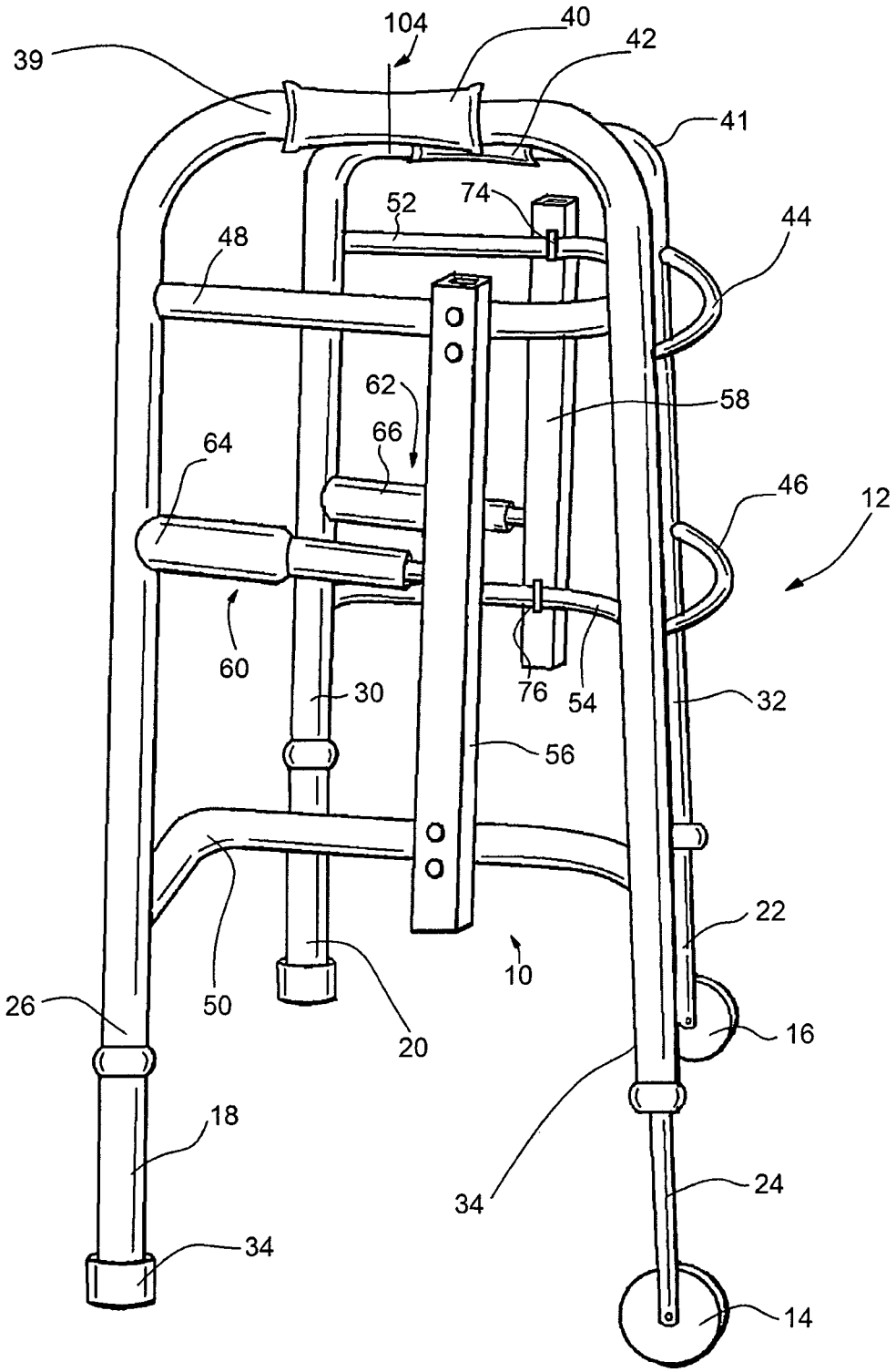
FIG. 1 is a side perspective view of a presently preferred embodiment of the present invention showing a walker.
Figure 2:
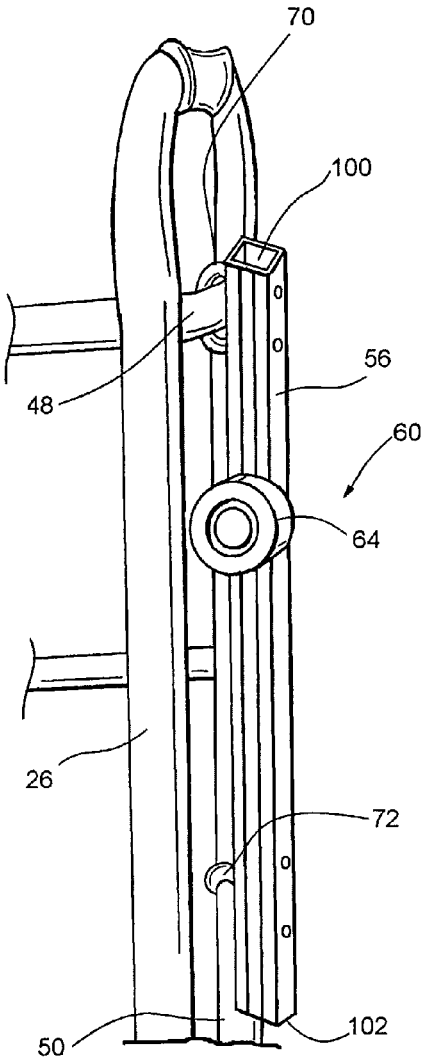
FIG. 2 is a rear perspective view of a portion of the walker shown in FIG. 1.

In accordance with a presently preferred embodiment of the present invention, a device a lift assist 10 of a presently preferred embodiment is provided as or with a walker 12. This embodiment has wheels 14,16, and other embodiments may, or may not have these or other wheels. If a walker 12 does have wheels 14,16, brakes with brake handles may also be used to assist in preventing those wheels from turning under certain circumstances.

The walker 12 is elevationally adjustably such as by having feet 18-24 be received within legs 26, 30,32,34 as would be understood by those of ordinary skill in the art. Rear feet 18,20 have rubber stoppers 36,38, but could have wheels such as wheels 14,16 as discussed above. Similarly, front feet 22,24 could have stoppers such as stoppers 36,38 for at least some embodiments.

Legs 26, 30,32,34 are preferably formed so that legs 26,34 meet at a U or upper extension 39 at first hand hold 40 and legs 30,32 also meet at a U or upper extension 41 at second hand hold 42. These are the traditional hand holds 40,42 on the upper extensions 39,41 most walker constructions currently available on the market provide.

Also, most walker constructions provide for front top and bottom crossbars 44,46 as well as top and bottom side crossbars 48,50 (right) and 52,54 (left). The front crossbars 44,46 may coordinate to allow for the folding of the walker for some embodiments as would be known to those of ordinary skill in the art.

What separates this walker 12 from prior art constructions is the combination with a standing aid or lift assist 10. Lift assist 10 is provided in the form of opposing tracks 56,58 which are operably coupled to lift assist handles 60,62. Lift assist handles 60,62 preferably have grips 64,66 connected to bases 68 (only one is shown, the other is similarly constructed for at least the preferred embodiment). Lift assists 10 as shown and described herein may also be provided on structures other than walkers 12 for at least some embodiments.

Tracks 56,58 may be mounted internally or externally relative to side cross bars 48,50 and/or 52,54 or even in plane thereto, for at least some embodiments. Tracks 56,58 are shown connected to the respective side cross bars 48,50 and 52,54 with U-bolts 70,72 and 74,76 although other embodiments could connect the tracks 56,58 differently such as to leg(s) or upper extension(s) or otherwise.

When connecting in this manner, the tracks 56,58 can extend above and below the side cross bars 48,50 and 52,54 respectively. As will be discussed below, the range of motion of where the handles 60,62 can be positioned relative to the tracks is preferably infinitely adjustable within the range of motion. Furthermore, for much of the tracks 56,58 the handles 60,62 can be positioned relative thereto. Although the operation of only one handle 60 is shown in FIGS. 2-5, the other handle 62 operates similarly thereto for many embodiments.

Figure 3:
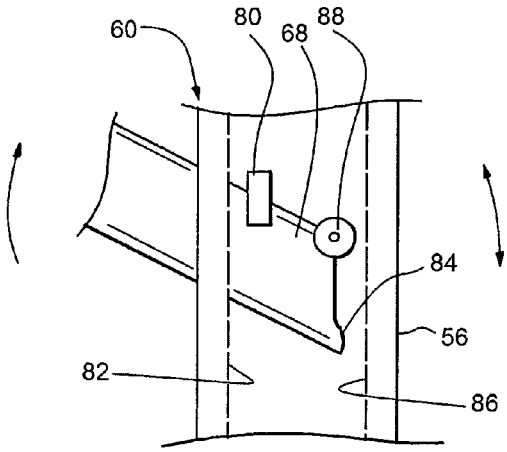
FIG. 3 is a partial cross sectional view of a portion of a lift assist handle in a track showing an ability to move up and down in the track in a first configuration.
Figure 4:
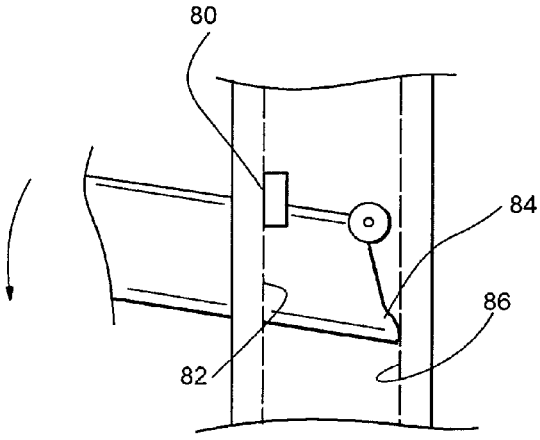
FIG. 4 is a partial cross sectional view similar to that of FIG. 3 in a second configuration showing the handle able to bear weight in the downward position at a desired elevation.
Figure 5:
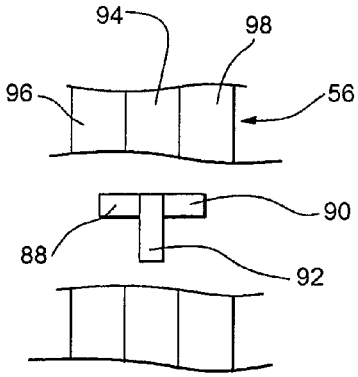
FIG. 5 is a rear partial cross section of the track and base portion of the lift assist handle.
Figure 6:
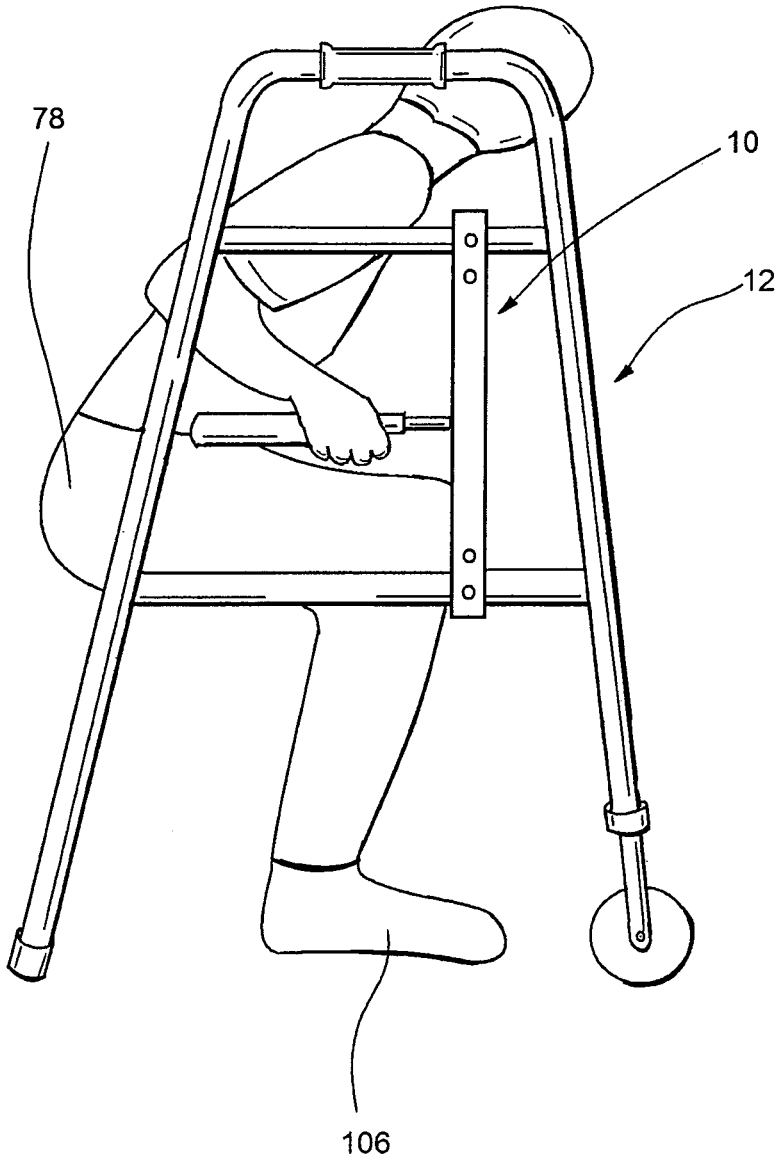
FIG. 6 is a side plan view of the walker of FIGS. 1-5 in use as a standing aid.

The handles 60,62 can preferably be elevationally adjusted by a user 78 shown in FIG. 6 with reference to FIGS. 2-5. Specifically, the user 78 can select an elevation for each of the handles 60,62 relative to the respective tracks 56,58. By rotating the handle 60 (and 62) and thus base 68, a friction fit of the base relative to the track 56 can be released. For the preferred embodiment this can happen by rotating the shoulder 80 off of first inside face 82 of track 56 which may also rotate the toe 84 off of the opposing second inside face 86 of track 56. For at least some embodiments, one or more rollers such as roller 88 may be useful to allow for the easy elevational positioning by the user 78 up or down as shown in FIG. 3.

By rotating the handle in an opposite direction to the direction shown in FIG. 3 as is shown in FIG. 4, the shoulder 80 contacts the first inside face 82 and the toe 84 contacts the opposing or second inside face 86 thereby providing a friction fit. Additional attempts at rotating in the direction shown in FIG. 4 may allow the user 78 to place weight on the handle 60 to assist as a standing aid in a support configuration.

FIG. 5 may be helpful to show that the shoulder 80 may have ears 88,90 which extend from support 92 with support 92 passing within slot 94 of track 56 while ears 88,90 are located within and behind extensions 96,98 with the opposite sides of extensions 96,98 forming the first inside face 82 for at least the preferred embodiment.

Caps 100,102 may retain the base 68 within the track(s) 56,58, and certainly other track and base constructions as would be understood by those of ordinary skill in the art may be employed with various embodiments.

One feature of the present embodiment of standing aid 10 is that a user may set the position of each of the handles 60,62. By taking pressure off of one of the handles 60,62 and rotating upward or forward, the handle, such as handle 62 can be moved upward (or even downward) an amount desired by the user 78 in an adjust configuration. Then the user 78 can apply pressure to that handle 62 and pull up on handle 60 to put it in a desired position and vice versa. In this manner, the user 78 can "walk up" to a standing position.

Many embodiments of the present invention do not require tools by the user 78 to select the elevation of each of the handles 60,62 which is believed to be an advantage for those embodiments. Additionally, the tracks 56,58 may be oriented to be vertical as illustrated or angled relative to a vertical for at least some embodiments.

Other embodiments may have the tracks positioned forward of a center 104 of the traditional and holds 40,42. Still others could connect the tracks 56,58, or even integrate the tracks into the front legs 32,34, front cross bars 44,46, or other appropriate location.

When not in use, it may be that the handles 60,62 are directed to a bottom 106 of the tracks by gravity and the motion of the walker 12 where they can be lifted to a desired position by the user 78 the next time they are needed, or they may be a the desired position, such as to assist from standing from a particularly low position.

Handles 60,62 may also be directed to be at a desired angle relative to the tracks when in the locked position shown in FIG. 4, such as perpendicular to the track, or more preferably, at least slightly upwardly angled, such as to assist an individual in getting into a desirable standing position over their feet 106, such as shown in FIG. 6. For slightly angled, the applicant provides at least about 5 degrees to about 30 degrees and more preferably about 5 degrees to about 10 degrees.

If a user decides not to "walk up" as described above, the user 78 could hold onto the handles 60,62 as they stand, and if they then need to stop at an intermediate point, downward pressure on the handles 60,62 can provide the friction fit to support at least some if not all of the weight of the user 78 at this position until they then resume standing to be able to transition to the traditional handles 40,42.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A walking and standing aid comprising:

a walker having legs downwardly extending relative to opposing horizontally disposed hand holds;

opposing downwardly extending tracks connected to the walker and having elongate slots operably coupled to lift assist handles, said lift assist handles having grips with bases received in the elongate slots of the tracks, and said bases being infinitely elevationally adjustable along the elongate slots within a range of motion relative to the tracks;

wherein said tracks are located below the hand holds thereby locating grips of the lift assist handles below the hand holds;

said lift assist handles having a lift configuration whereby the grip supports the weight of a user applied thereto, and an adjustment configuration allowing the lift assist handles to be elevationally adjusted relative to the track.

2. The walking and standing aid of claim 1 wherein the hand holds are located on upper extensions, said upper extensions each connecting front and rear legs of the downwardly extending legs.

3. The walking and standing aid of claim 1 wherein the front legs have wheels.

4. The walking and standing aid of claim 1 wherein the front legs have front cross bars.

5. The walking and standing aid of claim 1 further comprising opposing first side cross bars connecting a front leg to a rear leg of the downwardly extending legs.

6. The walking and standing aid of claim 5 wherein the downwardly extending tracks connect directly to the first side cross bars, respectively.

7. The walking and standing aid of claim 6 further comprising second side cross bars spaced elevationally from the first side cross bars and respectively connecting the front leg to the rear leg with the tracks connected to the second side cross bars.

8. The walking and standing aid of claim 7 wherein the range of motion is intermediate the first and second side cross bars.

9. A walking and standing aid comprising:

a walker having legs a walker having legs downwardly extending relative to opposing horizontally disposed hand holds, opposing first side cross bars connecting a front leg to a rear leg of the downwardly extending legs; and opposing downwardly extending tracks connected to the walker and having operably coupled to lift assist handles, said lift assist handles having grips with bases received in the tracks, and said bases being infinitely elevationally adjustable within a range of motion relative to the tracks, the downwardly extending tracks connecting directly to the first side cross bars, respectively and second side cross bars spaced elevationally from the first side cross bars and respectively connecting the front leg to the rear leg with the tracks connected to the second side cross bars wherein the range of motion is intermediate the first and second side cross bars;

said lift assist handles having a lift configuration whereby the grip supports the weight of a user applied thereto, and an adjustment configuration allowing the lift assist handles to be elevationally adjusted relative to the track;

wherein the tracks have a first inside face and a second oppositely directed inside face, and a shoulder of base contacts the first inside face and a toe contacts the second inside face in the lift configuration for a friction fit; and at least one of the toe and the shoulder are spaced from the respective first or second faces in the adjustment configuration.

10. The walking and standing aid of claim 9 wherein upward rotation of the grip relative to the base transitions the lift assist handles from the lift to the adjustment configuration.

11. The walking and standing aid of claim 10 wherein downward rotation of the grip relative to the base until the toe and shoulder contact the respective inside faces transitions the lift assist handles from the adjustment to the lift configurations.

12. The walking and standing aid of claim 9 wherein the base further comprises a roller located above the toe.

13. The walking and standing aid of claim 9 wherein the shoulder has a support extending through a slot in the first inside face and ears outwardly extending relative to the support with the ears contacting the first inside face in the lift configuration.

14. A walking and standing aid comprising:

a walker having legs downwardly extending relative to opposing horizontally disposed hand holds;

opposing downwardly extending tracks connected to the walker and having operably coupled to lift assist handles, said lift assist handles having grips with bases received in the tracks, and said bases being infinitely elevationally adjustable within a range of motion relative to the tracks;

said lift assist handles having a lift configuration whereby the grip supports the weight of a user applied thereto, and an adjustment configuration allowing the lift assist handles to be elevationally adjusted relative to the track, said grip connected to a toe which provides a friction fit with the track in the lift configured with the grip supporting the weight of the user and;

wherein transition from the lift configuration to the adjustment configuration for the respective lift assist handle occurs through lifting upwardly on the respective grip thereby releasing the friction fit of the toe with the track allowing the grip to be moved elevationally relative to the track in the adjustment configuration.

15. A walker and standing aid comprising:

a walker having legs downwardly extending relative to opposing horizontally disposed hand holds;

opposing tracks connected to the walker and having elongate slots operably coupled to lift assist handles, said lift assist handles having grips with bases received in the elongate slots of the tracks, and said bases being elevationally adjustable along the elongate slots within a range of motion relative to the tracks with the grips located below the hand holds;

said lift assist handles having a lift configuration whereby the grip supports the weight of a user applied downwardly thereto and an adjustment configuration allowing the lift assist handles to be elevationally adjusted relative to the track.

16. The walking and standing aid of claim 15 wherein transition from the lift configuration to the adjustment configuration for the respective lift assist handle occurs through lifting upwardly on the respective grip and pushing downwardly directs the lift assist handle towards the lift configuration.

17. The walking and standing aid of claim 16 further comprising opposing first side cross bars connecting a front leg to a rear leg of the downwardly extending legs, and said tracks connected to the first side cross bars.

18. The walking and standing aid of claim 17 further comprising opposing second side cross bars connecting the front leg to the rear leg of the downwardly extending legs, and said tracks connected to the second side cross bars in elevational displacement relative to the first cross bars.

19. The walking and standing aid of claim 18 wherein the range of motion is intermediate the first and second side cross bars.

20. The walker of claim 15 wherein the lift assist handles are each infinitely elevationally adjustable within the range of motion.

* * * * *